US010480266B2

(12) United States Patent
Crowley

(10) Patent No.: US 10,480,266 B2
(45) Date of Patent: Nov. 19, 2019

(54) SHIFTING TOOL RESETTABLE DOWNHOLE

(71) Applicant: WEATHERFORD TECHNOLOGY HOLDINGS, LLC, Houston, TX (US)

(72) Inventor: Scott Crowley, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 0 days.

(21) Appl. No.: 15/602,636

(22) Filed: May 23, 2017

(65) Prior Publication Data

US 2018/0340385 A1 Nov. 29, 2018

(51) Int. Cl.

| | |
|---|---|
| ***E21B 23/00*** | (2006.01) |
| ***E21B 34/10*** | (2006.01) |
| ***E21B 34/14*** | (2006.01) |
| ***E21B 34/00*** | (2006.01) |

(52) U.S. Cl.

CPC ..... *E21B 23/00* (2013.01); *E21B 34/10* (2013.01); *E21B 34/14* (2013.01); *E21B 2034/007* (2013.01)

(58) Field of Classification Search

CPC ..... E21B 23/00; E21B 34/10; E21B 2034/007
See application file for complete search history.

(56) References Cited

U.S. PATENT DOCUMENTS

| | | | |
|---|---|---|---|
| 4,124,070 | A | 11/1978 | King et al. |
| 4,436,152 | A | 3/1984 | Fisher, Jr. et al. |
| 5,549,161 | A | 8/1996 | Gomez et al. |
| 5,641,023 | A | 6/1997 | Ross et al. |
| 2009/0071655 | A1 | 3/2009 | Fay |
| 2017/0037706 | A1 | 2/2017 | Cho et al. |

FOREIGN PATENT DOCUMENTS

| | | | |
|---|---|---|---|
| GB | 2213181 | A | 8/1989 |
| WO | 2009/035917 | A2 | 3/2009 |
| WO | 2010/129631 | A1 | 11/2010 |

OTHER PUBLICATIONS

Specification and Drawings filed May 23, 2017 for U.S. Appl. No. 15/602,275, 25 pages.
International Search Report with Written Opinion dated Jul. 16, 2018 for PCT Patent Application No. PCT/US2018/027931, 15 pages.
International Search Report with Written Opinion dated Jul. 16, 2018 for PCT Patent Application No. PCT/US2018/027937, 13 pages.
Office Action dated Mar. 18, 2019 for U.S. Appl. No. 15/602,275, 17 pages.

*Primary Examiner* — D. Andrews
*Assistant Examiner* — Manuel C Portocarrero
(74) *Attorney, Agent, or Firm* — Smith IP Services, P.C.

(57) ABSTRACT

A shifting tool for use in displacing a component of a well tool can include an inner mandrel, at least one shifting key, at least one reset dog, and a retraction sleeve. The shifting key retracts relative to the inner mandrel in response to displacement of the retraction sleeve relative to the shifting key, and the reset dog extends relative to the inner mandrel in response to displacement of the inner mandrel relative to the reset dog. A method of operating a shifting tool can include engaging the shifting tool with a component of a well tool in a well, and applying a force from the shifting tool to the well tool component, thereby causing one or more reset dogs to extend into engagement with the well tool component.

20 Claims, 7 Drawing Sheets

SHIFTING TOOL RESETTABLE DOWNHOLE

BACKGROUND

This disclosure relates generally to equipment utilized and operations performed in conjunction with subterranean wells and, in an example described below, more particularly provides a shifting tool that is resettable downhole.

Shifting tools can be used to operate or actuate a variety of different well equipment. For example, a shifting tool can be used to operate a valve (such as, a sliding sleeve valve or a ball valve) between open and closed positions.

Typically, when using a shifting tool to operate an item of well equipment, a force is applied to a component of the well equipment from the shifting tool. The force may be supplied to the shifting tool via a conveyance (such as, a wireline, slickline or coiled tubing).

Occasionally, the applied force is excessive (for example, if the component of the equipment is stuck, the equipment is damaged, etc.), and the shifting tool is disengaged from the equipment as a result. The shifting tool can then be retrieved to surface, and can be redressed if another attempt is to be made to operate the well equipment.

Thus, it will be appreciated that improvements are continually needed in the arts of designing, constructing and operating shifting tools for use in wells. The improvements may be useful with a variety of different shifting tool designs for operation of a variety of different types of well equipment.

DETAILED DESCRIPTION

Figure 1:
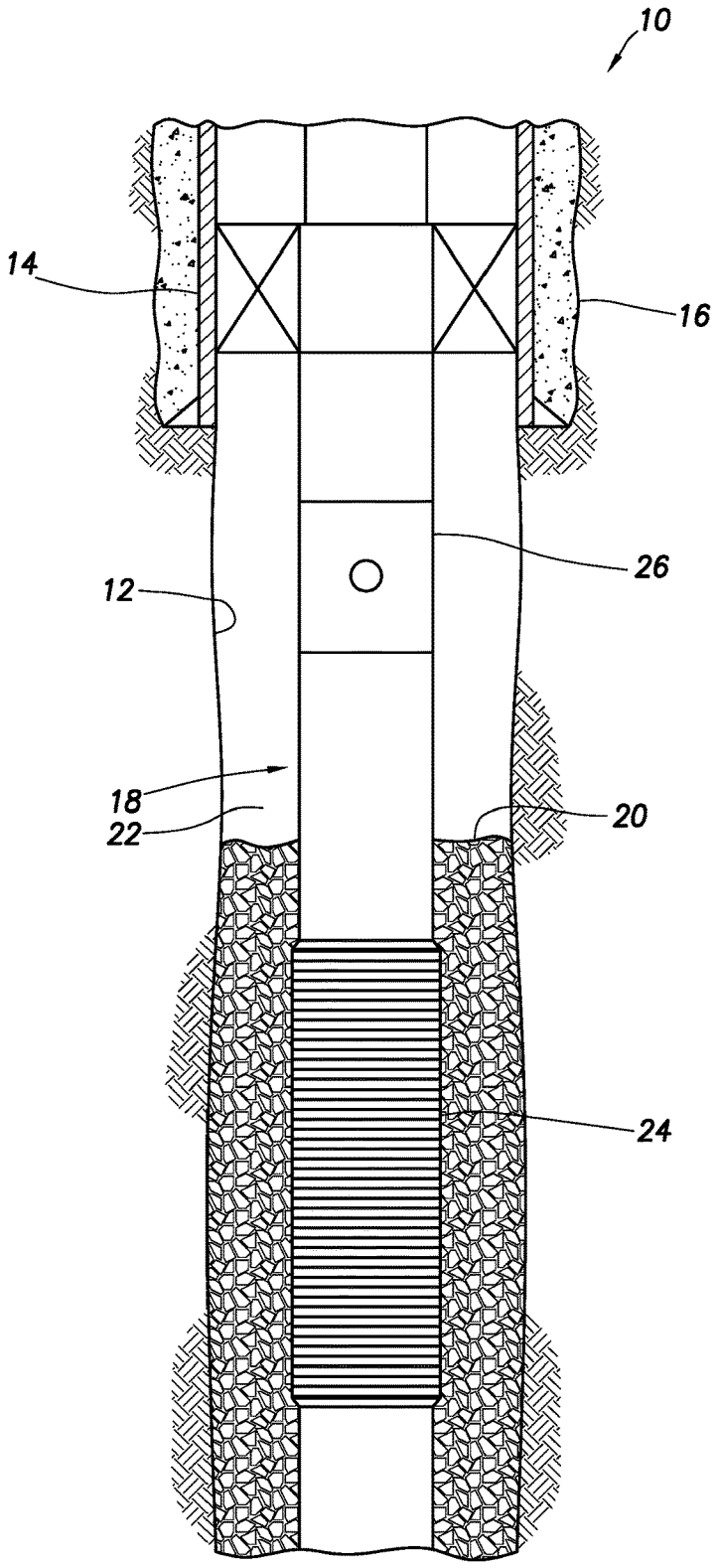
FIG. 1 is a representative partially cross-sectional view of an example of a well system and associated method which can embody principles of this disclosure.

Representatively illustrated in FIG. 1 is a system 10 for use with a subterranean well, and an associated method, which system and method can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, a wellbore 12 has been drilled into the earth. An upper section of the wellbore 12 (as viewed in FIG. 1) has been lined with casing 14 and cement 16, but a lower section of the wellbore remains uncased or open hole.

A completion string 18 has been installed in the wellbore 12. In this example, the completion string 18 represents a simplified gravel pack completion string that is configured for placement of gravel 20 in an annulus 22 surrounding one or more well screens 24. However, the scope of this disclosure is not limited to use of a gravel pack completion string, or to gravel packing at all.

The completion string 18 includes a well tool 26 that selectively permits and prevents flow between the annulus 22 and an interior of the completion string 18. In this example, the well tool 26 comprises a sliding sleeve valve. The well tool 26 is operated by longitudinally shifting a sliding sleeve (not visible in FIG. 1, see FIGS. 3-7) of the valve between open and closed positions.

Figure 2:
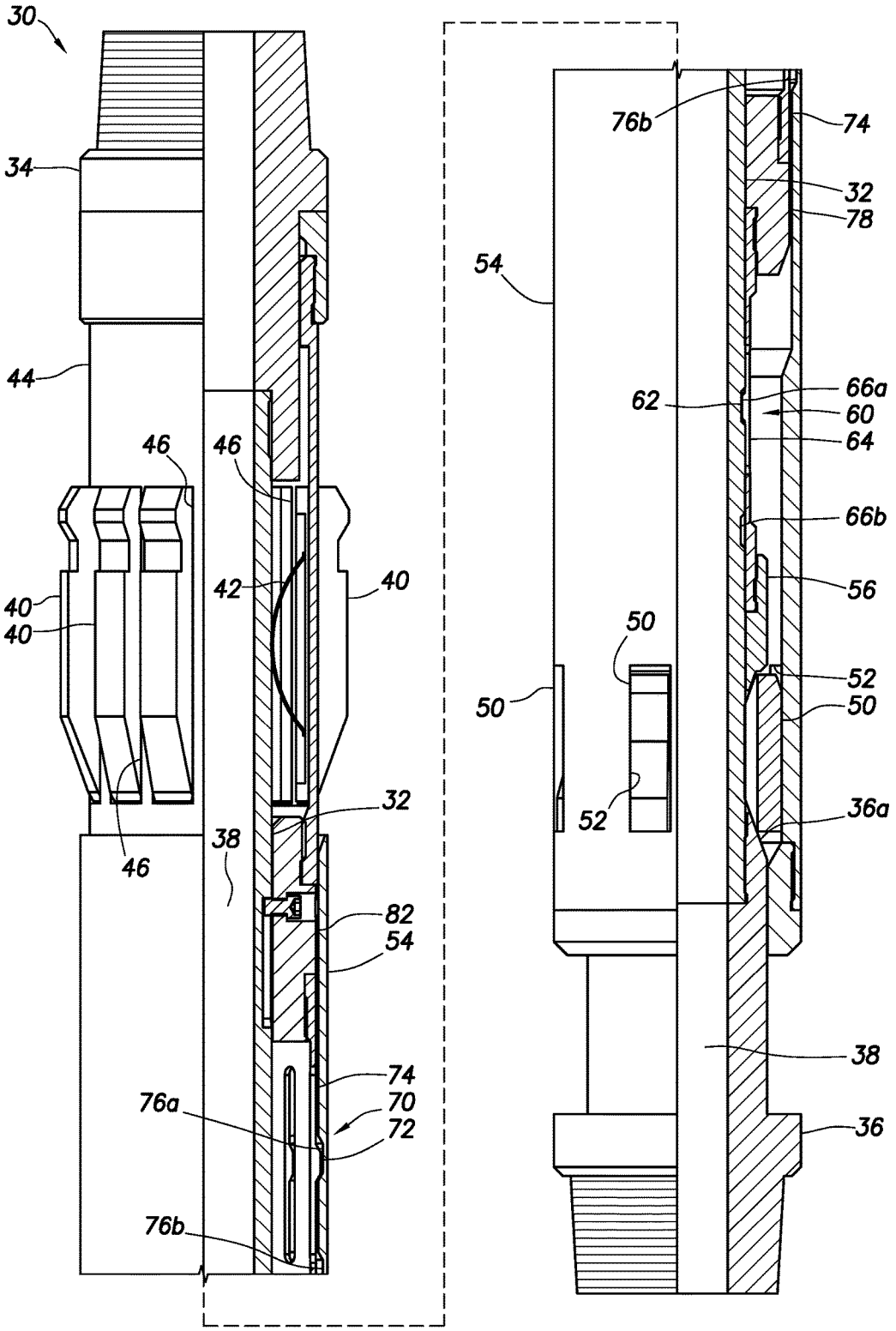
FIG. 2 is a representative partially cross-sectional view of a shifting tool that may be used in the system and method of FIG. 1, and which can embody the principles of this disclosure.

Referring additionally now to FIG. 2, an example of a shifting tool 30 is representatively illustrated. The shifting tool 30 may be used to shift the sliding sleeve of the valve (well tool 26) as described above in the system 10 and method of FIG. 1, or the shifting tool 30 may be used to shift other well tool components in other systems and methods, in keeping with the principles of this disclosure.

In the FIG. 2 example, the shifting tool 30 includes an inner generally tubular mandrel 32, with upper and lower connectors 34, 36 at opposite ends of the inner mandrel. The connectors 34, 36 facilitate connection of the shifting tool 30 to a conveyance (such as, a wireline, slickline, coiled tubing, etc.). In the FIG. 1 system 10 and method, the conveyance would be used to convey the shifting tool 30 longitudinally through the completion string 18.

A flow passage 38 extends longitudinally through the shifting tool 30. When conveyed by coiled tubing or other tubular string, the flow passage 38 is in fluid communication with an inner flow passage of the tubular string. However, the flow passage 38 is optional, and it is not necessary for the inner mandrel 32 to have a tubular shape.

Circumferentially distributed about the inner mandrel 32 are engagement members 40. In this example, the engagement members 40 are of the type known to those skilled in the art as "shifting keys," in that they each have an external profile formed thereon that is shaped to complementarily engage a corresponding internal profile formed in a well tool component. Shifting keys can be used to transmit force between a shifting tool and a well tool component, in order to displace the component.

In other examples, the engagement members 40 could have other forms. A C-ring or snap ring could be used as a single engagement member 40 that releasably engages a well tool component. Thus, the scope of this disclosure is not limited to use of any particular number, type, shape or configuration of the engagement members 40.

The engagement members 40 are radially outwardly biased by springs 42. As depicted in FIG. 2, the engagement members 40 are outwardly extended relative to the inner mandrel 32 by the springs 42. If resilient members (such as, C-rings, snap rings, collets, etc.) are used for the engagement members 40, the springs 42 may not be used.

A retainer sleeve 44 has openings 46 therein for receiving the engagement members 40. The engagement members 40 are radially slidable in the openings 46, but relative longitudinal and rotational displacement of the engagement members 40 relative to the retainer sleeve 44 is substantially prevented.

Another set of engagement members 50 is circumferentially distributed about the inner mandrel 32 near a lower end thereof. The engagement members 50 are radially slidable in openings 52 formed through a retraction sleeve 54, but relative longitudinal and rotational displacement of the engagement members 50 relative to the retraction sleeve 54 is substantially prevented.

The engagement members 50 in this example are in the form of reset dogs configured for engaging a well tool component and enabling the shifting tool 30 to be reset downhole, as described more fully below. Any number, shape configuration or type of members may be used for the engagement members 50, in keeping with the principles of this disclosure.

As depicted in FIG. 2, the engagement members 50 are retracted radially inward relative to the inner mandrel 32. However, note that the lower connector 36 has an upper inclined surface 36*a* formed thereon so that, if the lower connector 36 is displaced upward relative to the engagement members 50, the engagement members 50 will be urged radially outward in the openings 52 relative to the inner mandrel 32 to an extended position.

A support member 56 can be displaced on the inner mandrel 32 relative to the inclined surface 36*a* of the upper connector 36, to thereby selectively permit or prevent the engagement members 50 from displacing to their retracted positions (as viewed in FIG. 2) from their extended positions (see FIGS. 3-6).

A detent device 60 releasably secures the support member 56 in two longitudinal positions relative to the inner mandrel 32. Projections 62 formed in circumferentially distributed flexible collets 64 engage recesses 66*a,b* formed on the inner mandrel 32.

As depicted in FIG. 2, the projections 62 are engaged with the recess 66*a*, thereby maintaining the support member 56 longitudinally spaced apart from the lower connector 36 inclined surface 36*a*. Thus, the engagement members 50 are permitted to displace radially inward to their retracted positions.

If, however, the projections 62 are engaged with the recess 66*b*, the longitudinal spacing between the support member 56 and the lower connector 36 will be shortened, so that the engagement members 50 will be retained in their outwardly extended positions.

Another detent device 70 releasably secures the engagement members 40 in two longitudinal positions relative to the retraction sleeve 54. Projections 72 formed on circumferentially distributed flexible collets 74 engage recesses 76*a,b* formed in the retraction sleeve 54.

As depicted in FIG. 2, the projections 72 are engaged with the recess 76*a*, thereby maintaining the retraction sleeve 54 longitudinally spaced apart from the engagement members 40. Thus, the engagement members 40 are biased toward their extended positions by the springs 42.

If, however, the projections 72 are engaged with the recess 76*b*, the retraction sleeve 54 will be overlying the engagement members 40 sufficiently to cause the engagement members to retract inward relative to the inner mandrel 32.

Note that a connector 78 connects the collets 64 to the collets 74, and another connector 82 connects the collets 74 to the retainer sleeve 44. The connectors 78, 82 can displace longitudinally relative to the inner mandrel 32, but the connector 82 is prevented from displacing rotationally relative to the inner mandrel. Thus, longitudinal force can be transmitted in both directions between the engagement members 40 and the support member 56 via the retainer sleeve 44, the collets 64, 74 and the connectors 78, 82.

This subassembly (engagement members, support member 56, retainer sleeve 44, collets 64, 74 and connectors 78, 82) is longitudinally slidable on the inner mandrel 32 between the two longitudinal positions defined by the detent device 60. Similarly, a subassembly including the engagement members 50 and the retraction sleeve 54 is longitudinally slidable on the other subassembly between the two longitudinal positions defined by the detent device 70.

In FIG. 2, the shifting tool 30 is in a run-in configuration, in which the shifting tool can be conveyed into a well and engaged with a well tool (such as the well tool 26 or another type of well tool) to shift a component of the well tool. In this configuration, the engagement members 40 are extended and the engagement members 50 are retracted.

A conveyance (such as, a wireline, slickline or tubing) would be connected to one or both of the end connectors 34, 36 to convey the shifting tool 32 into the well, and to apply longitudinal force to the well tool component. The longitudinal force can be applied in either longitudinal direction, and can be applied by slacking off or applying tension to the conveyance at surface, by activating a downhole actuator to apply the force, or by another technique. The scope of this disclosure is not limited to any particular technique for conveying the shifting tool 30 in a well, or for applying longitudinal force to the shifting tool.

Referring additionally now to FIGS. 3-7, various stages in operation of the shifting tool 30 are representatively illustrated. The shifting tool 30 is depicted as being used to shift a component 80 of the well tool 26 in the system 10 and method of FIG. 1. However, the scope of this disclosure is not limited to shifting of any particular type of well tool component in any particular system or method.

Figure 3:
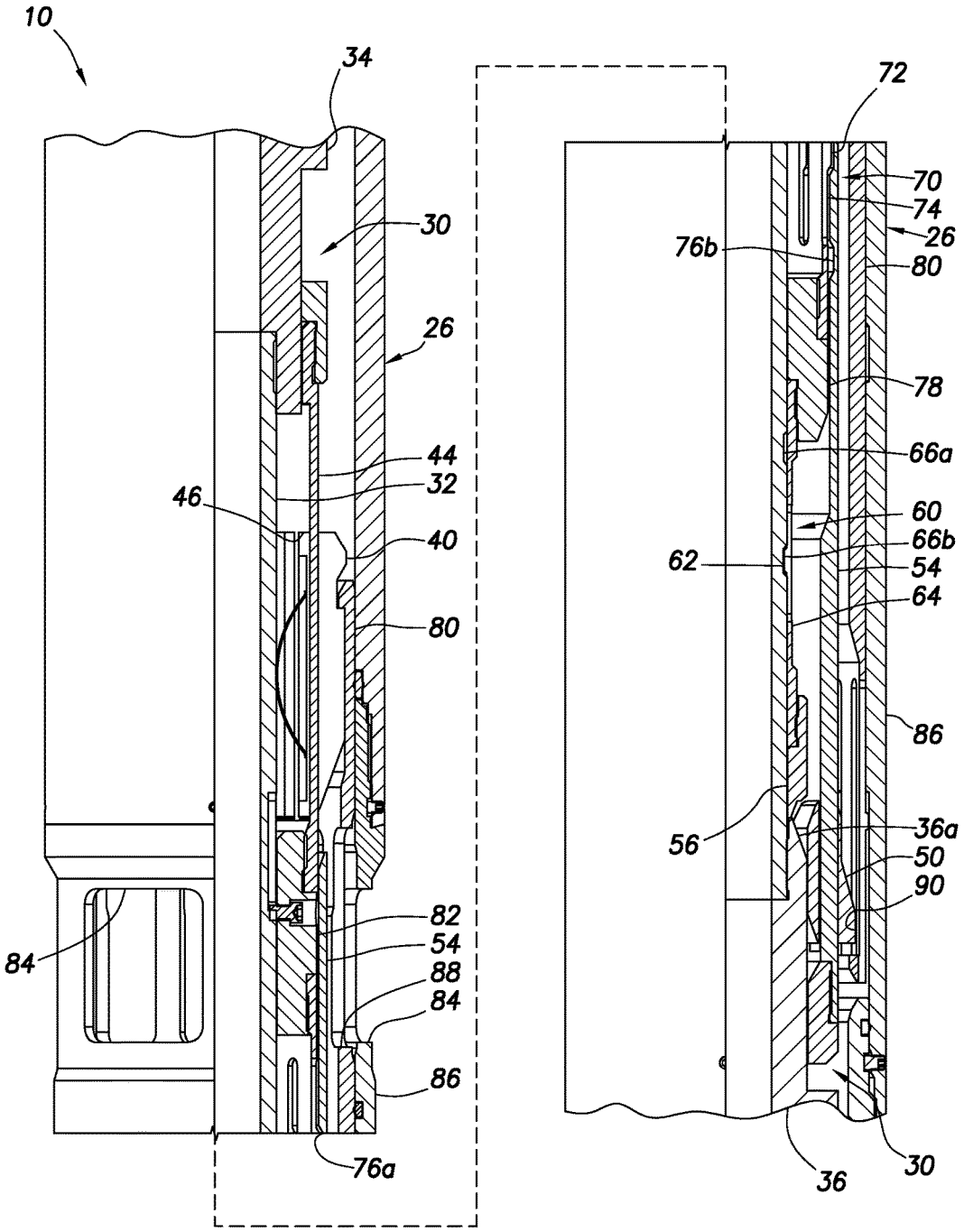
FIGS. 3-7 are representative partially cross-sectional views of various shifting tool operational configurations.

In the FIGS. 3-7 example, the component 80 is a sliding sleeve that is used to selectively permit or prevent flow through openings 84 formed through a sidewall of an outer housing 86 of the well tool 26. As depicted in FIG. 3, the component 80 is in a lower open position, in which flow is permitted through the openings 84 (due to the openings 84 being aligned with openings 88 formed through the component 80).

The shifting tool 30 has been engaged with the well tool component 80 by engaging the engagement members 40 with an upper section of the component 80 having a suitable internal profile formed therein. In an attempt to shift the component 80 upward (as viewed in FIG. 3) to a closed position, a longitudinal force has been applied from the engagement members 40 to the component 80, for example, by lifting on the inner mandrel 32 via the conveyance used to position the shifting tool 30 in the well tool 26.

As depicted in FIG. 3, the attempt to shift the component 80 upward was unsuccessful. An additional amount of longitudinal force was then applied, with the additional force being sufficient (greater than or equal to a predetermined level) to cause the collets 64 to flex outward and then engage the recess 66*b* as the inner mandrel 32 displaces upward relative to the support member 56 and engagement members 50.

The engagement members 50 are now extended outward into engagement with the well tool component 80. The engagement members 50 in this example are in the form of reset dogs that engage a recess 90 in the component 80, in order to enable resetting of the shifting tool 30 downhole.

Figure 4:
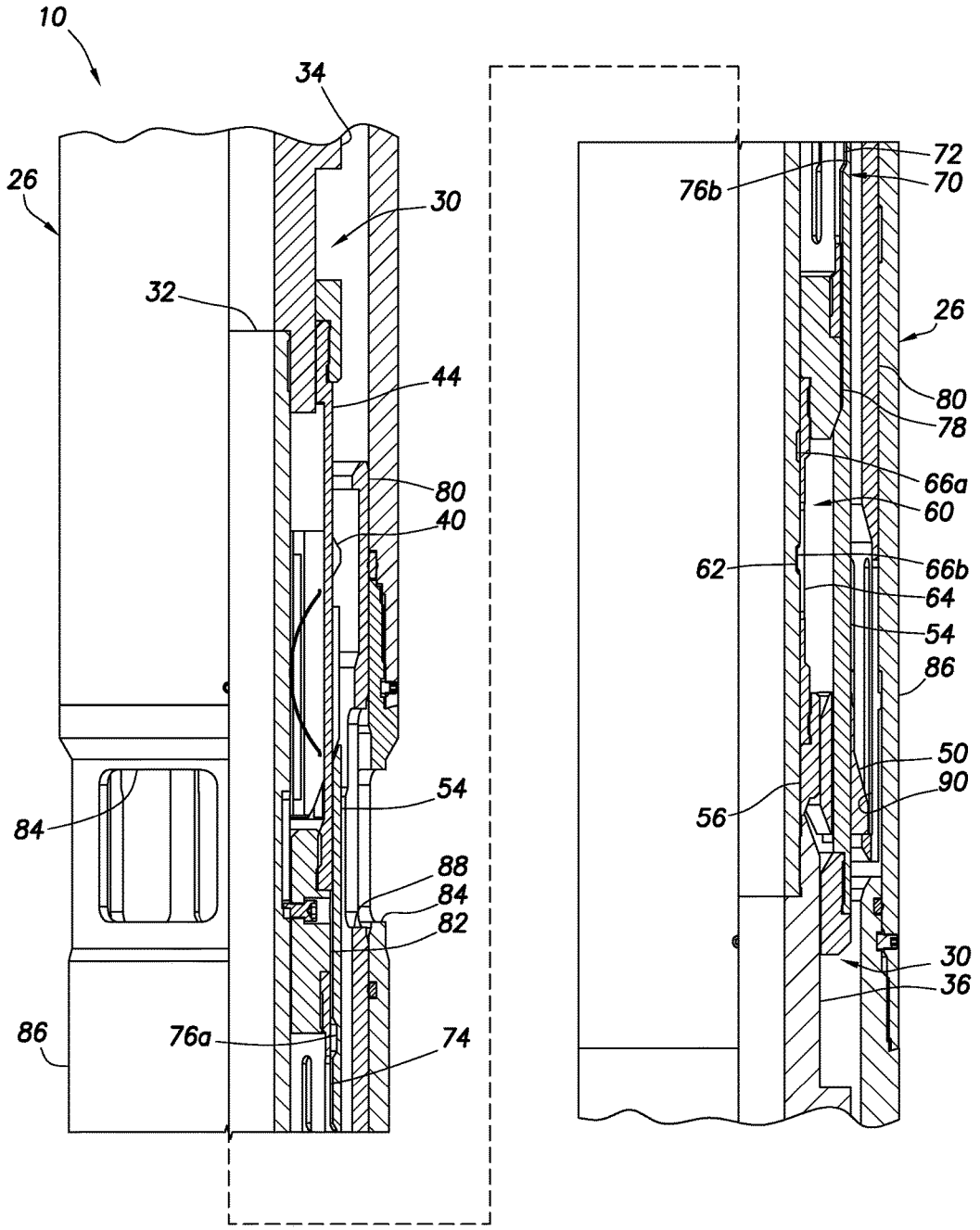

In FIG. 4, a downwardly (as viewed in FIG. 4) directed longitudinal force has been applied to the shifting tool 30. The downward longitudinal force could be applied, for example, by slacking off on a wireline, slickline or tubing conveyance at surface, by operating a downhole actuator, etc.

The engagement of the engagement members 50 with the component 80 has prevented the retraction sleeve 54 from displacing downward substantially with the remainder of the shifting tool 30 in response to the longitudinal force. As a result, the engagement members 40 have displaced downward relative to the retraction sleeve 54, so that the engagement members 40 are retracted radially inward and out of engagement with the component 80.

Note that the longitudinal force applied to the shifting tool 30 is sufficient (greater than or equal to a predetermined level) to cause the collets 74 to flex inward, disengage from the recess 76*a*, and then engage the recess 76*b*. The collets 74 are connected to (via the connector 82), and displace longitudinally with, the engagement members 40.

Thus, as depicted in FIG. 4, the engagement members 40 are retracted out of engagement with the component 80 as a result of the downwardly directed longitudinal force applied to the setting tool 30. The engagement members 50 remain engaged with the profile 90 in the component 80.

Figure 5:
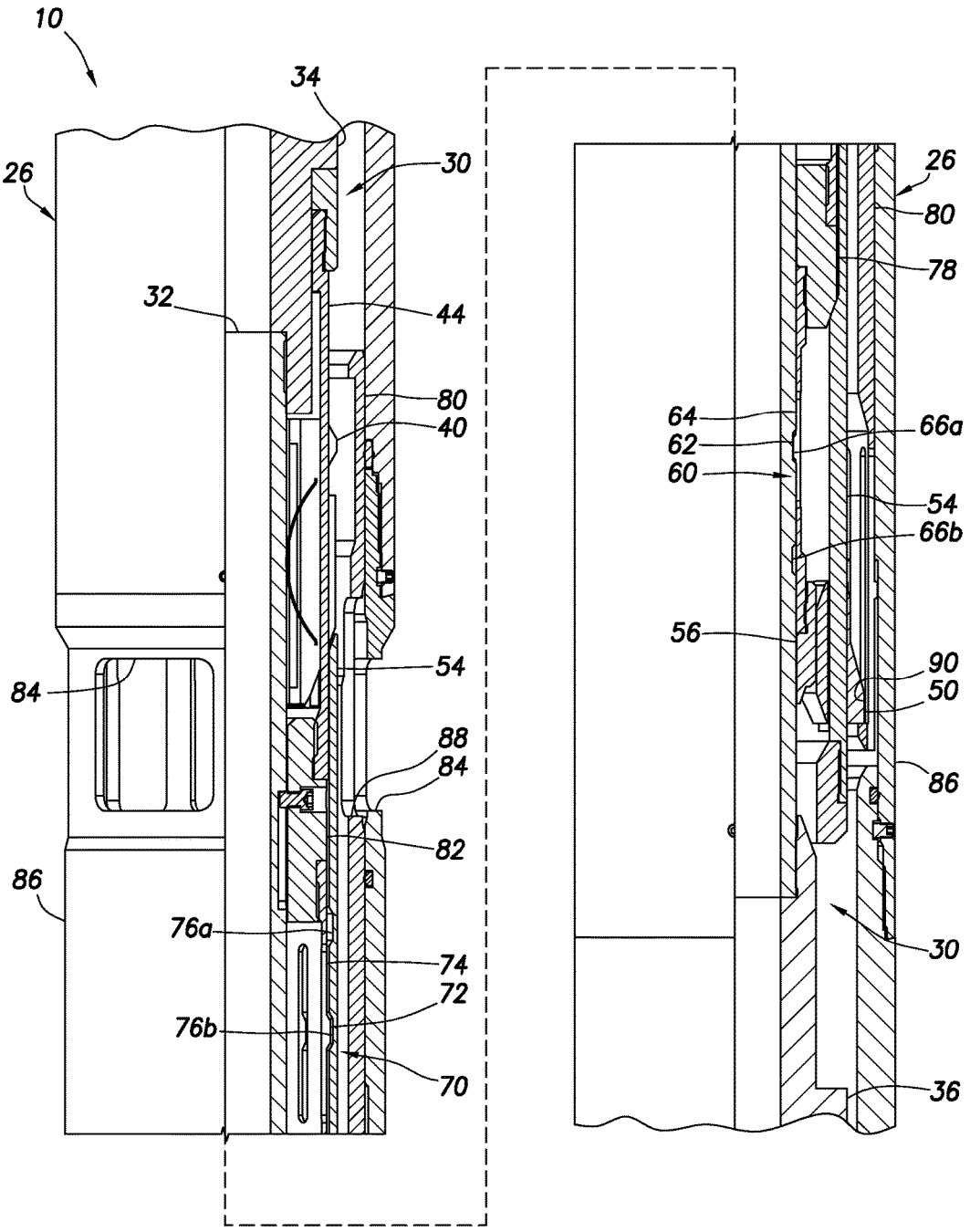

In FIG. 5, an additional downwardly directed longitudinal force has been applied to the setting tool 30. In this example, the force applied to achieve the FIG. 4 configuration is less than the force applied to achieve the FIG. 5 configuration.

The longitudinal force applied to the shifting tool 30 to achieve the FIG. 5 configuration is sufficient (greater than or equal to a predetermined level) to cause the collets 64 to flex outward, disengage from the recess 66*b*, and then engage the recess 66*a*. Note that the lower connector 36 is now spaced longitudinally farther from the support member 56.

Figure 6:
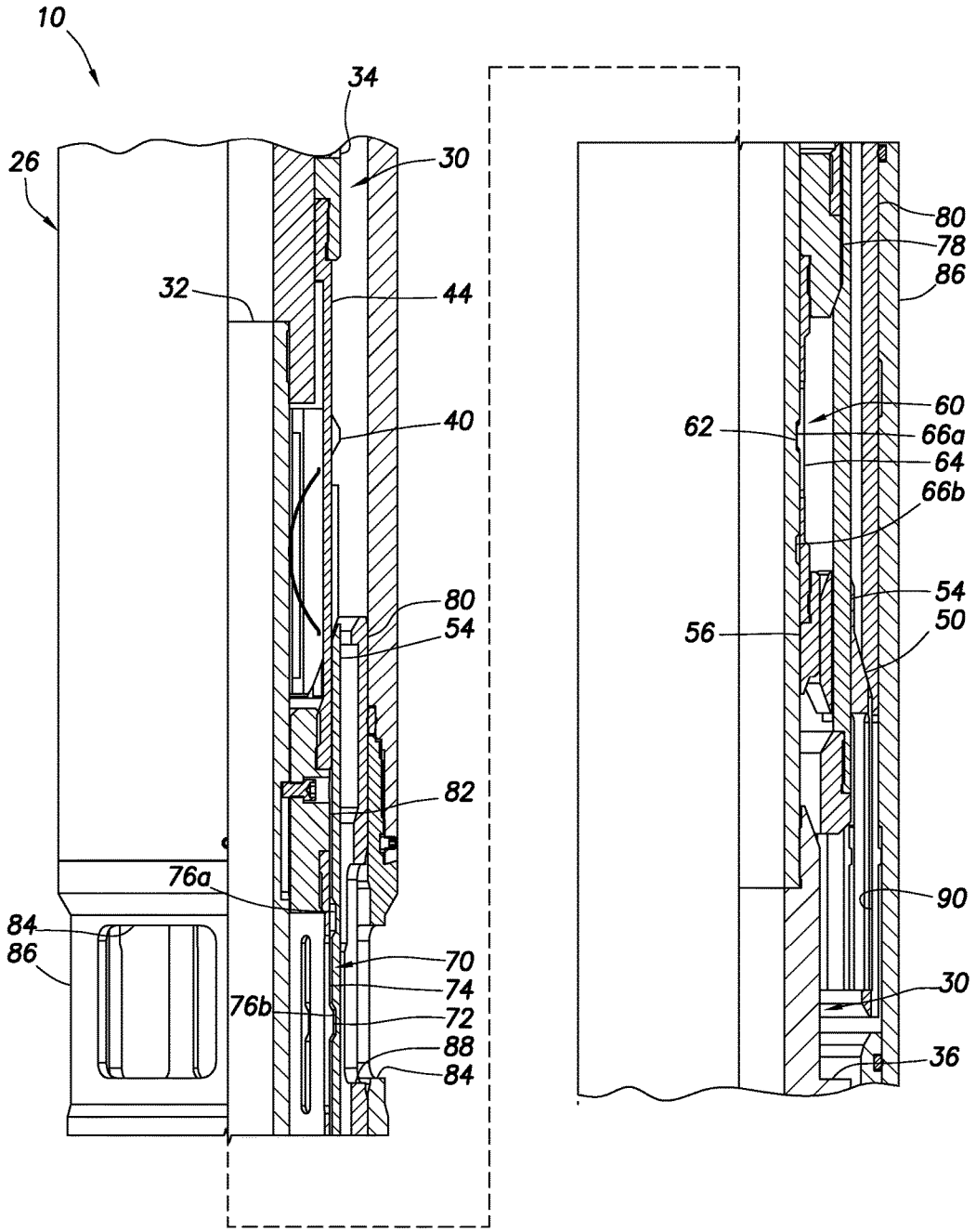

In FIG. 6, an upwardly directed longitudinal force has been applied to the shifting tool 30. The shifting tool 30 is now displaced upward somewhat relative to the well tool 26, as compared to the FIG. 5 configuration.

Since the engagement members 50 remain in their extended positions, and in engagement with the profile 90 of the component 80, the engagement members 50 now contact the component 80 at an upper end of the profile 90. A downwardly directed longitudinal force can now be transmitted from the component 80 to the engagement members 50 and the retraction sleeve 54 via this contact.

Figure 7:
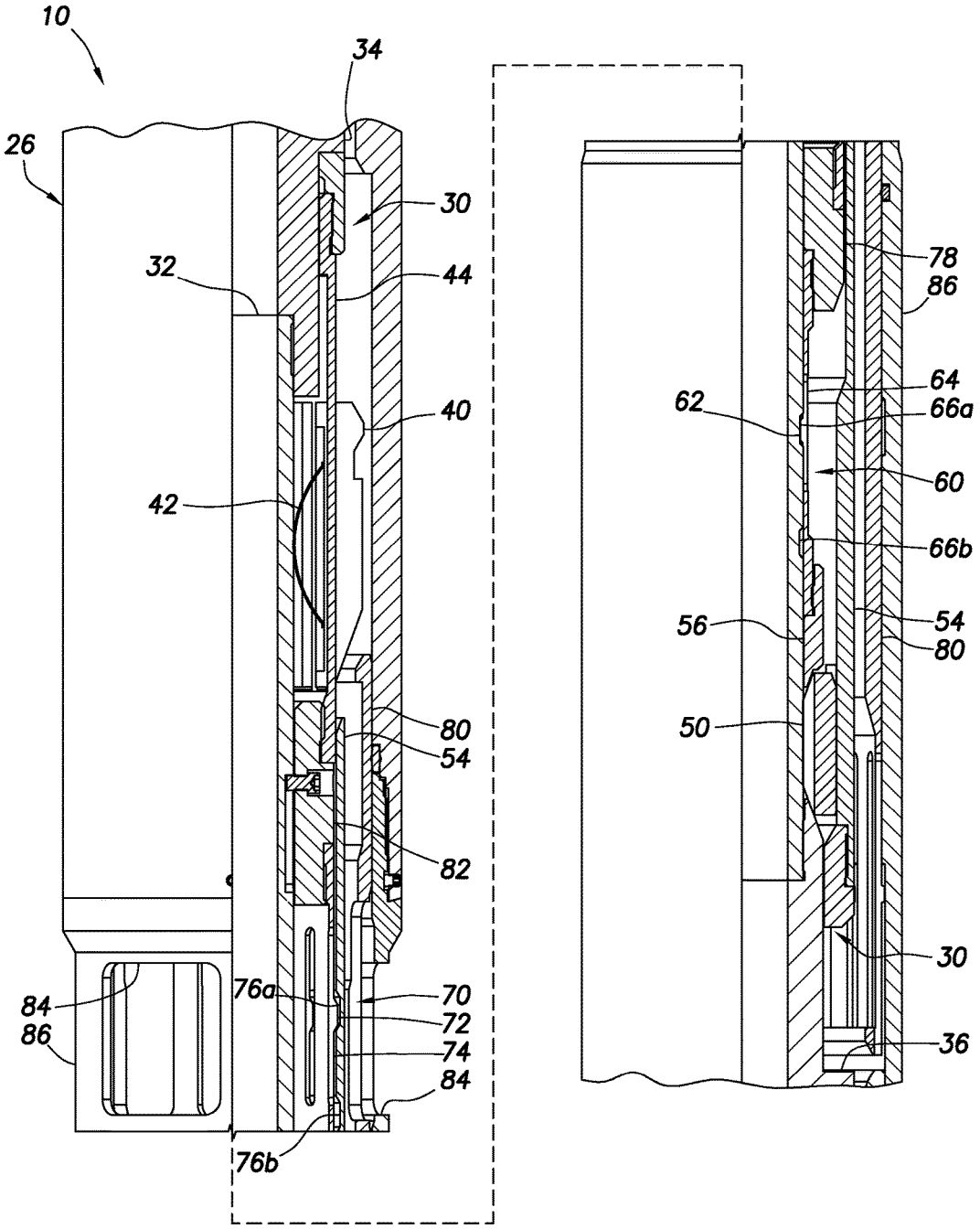

In FIG. 7, an additional upwardly directed longitudinal force has been applied to the shifting tool 30. As a result, the shifting tool 30 is displaced upward somewhat relative to the well tool 26, as compared to the FIG. 6 configuration.

The contact between the engagement members 50 and the upper end of the profile 90 (see FIG. 6) has resisted upward displacement of the engagement members 50 and retraction sleeve 54 with the remainder of the shifting tool 30, until the additional upward longitudinal force was sufficient (greater than or equal to a predetermined level) to cause the collets 74 to flex inward, disengage from the recess 76*b*, and then engage the recess 76*a*.

The engagement members 40 are no longer retained in their retracted positions by the retraction sleeve 54, and the engagement members 50 are no longer radially outwardly supported by the support member 56. The engagement members 40 are in their extended positions, and the engagement members 50 are in their retracted positions.

Note that this FIG. 7 configuration is essentially the same as the run-in configuration of FIG. 2. Thus, the shifting tool 30 has been effectively "reset" downhole.

The shifting tool 30 can now be used in a further attempt to shift the well tool component 80 by again engaging the engagement members 40 with the component 80 and applying an upwardly directed longitudinal force to the shifting tool 30. If this further attempt is unsuccessful, the technique described above can be used to again reset the shifting tool 30 downhole. Any number of resets can be accomplished downhole, without a need to retrieve the shifting tool 30 to surface.

It may now be fully appreciated that the above disclosure provides significant advancements to the arts of designing, constructing and operating shifting tools for use in wells. In one example described above, the shifting tool 50 can be reset downhole by applying downwardly directed force to the shifting tool, and then upwardly directed force to the shifting tool, after an unsuccessful attempt to shift a well tool component 80 upward.

The above disclosure provides to the arts a shifting tool 30 for use in displacing a component 80 of a well tool 26. In one example, the shifting tool 30 can include an inner mandrel 32, at least one shifting key (such as, engagement members 40), at least one reset dog (such as, engagement members 50), and a retraction sleeve 54. The shifting key 40 retracts relative to the inner mandrel 32 in response to relative displacement between the retraction sleeve 54 and the shifting key 40, and the reset dog 50 extends relative to the inner mandrel 32 in response to relative displacement between the inner mandrel 32 and the reset dog 50.

The reset dog 50 may extend relative to the inner mandrel 32 in response to displacement of the inner mandrel 32 in a first longitudinal direction (such as, upward in the FIGS. 2-7 example) relative to the shifting key 40. The shifting key 40 may retract relative to the inner mandrel 32 in response to displacement of the inner mandrel 32 in an opposite second longitudinal direction (such as, downward in the FIGS. 2-7 example) relative to the reset dog 50.

The shifting tool 30 can include a first detent device 60 that releasably secures the inner mandrel 32 in at least two longitudinal positions relative to the shifting key 40, and a second detent device 70 that releasably secures the retraction sleeve 54 in at least two longitudinal positions relative to the shifting key 40.

The first detent device 60 may comprise at least one flexible collet 64. The longitudinal positions of the inner mandrel 32 can include a first position in which the reset dog 50 is retracted relative to the inner mandrel 32, and a second position in which the reset dog 50 is extended relative to the inner mandrel 32.

The second detent device 70 may comprise at least one flexible collet 74. The longitudinal positions of the retraction sleeve 54 can include a first position in which the shifting key 40 is extended relative to the inner mandrel 32, and a second position in which the retraction sleeve 54 retains the shifting key 40 retracted relative to the inner mandrel 32.

A method of operating a shifting tool 30 in a subterranean well is also provided to the arts by the above disclosure. In one example, the method can comprise engaging the shifting tool 30 with a component 80 of a well tool 26 in the well, and applying a first force in a first direction from the shifting tool 30 to the well tool component 80, thereby causing one or more reset dogs 50 to extend into engagement with the well tool component 80.

After the step of applying the first force, the method may include applying a second force in a second direction from the shifting tool 30 to the well tool component 80, the second direction being opposite to the first direction.

The engaging step can include engaging shifting keys 40 of the shifting tool 30 with a profile 90 of the well tool component 80. The step of applying the second force can include disengaging the shifting keys 40 from the profile 90.

The step of applying the second force can include applying the second force from the reset dogs 50 to the component 80. After the step of applying the second force, the method can include displacing the shifting tool 30 in the first direction relative to the well tool 26 while the reset dogs 50 remain engaged with the well tool component 80.

The engaging step can include engaging shifting keys 40 of the shifting tool 30 with a profile 90 of the well tool component 80, and the displacing step can include extending the shifting keys 40 outward from the shifting tool 30. The displacing step can include retracting the reset dogs 50 out of engagement with the well tool component 80.

A shifting tool 30 for use in displacing a component 80 of a well tool 26 is described above. In this example, the shifting tool 30 can include an inner mandrel 32, at least one first engagement member 40 outwardly extendable relative to the inner mandrel 32, a retraction sleeve 54, at least one second engagement member 50 outwardly extendable relative to the inner mandrel 32, a first detent device 60 that releasably secures the inner mandrel 32 in at least two longitudinal positions relative to the first engagement member 40, and a second detent device 70 that releasably secures the retraction sleeve 54 in at least two longitudinal positions relative to the first engagement member 40.

The longitudinal positions of the inner mandrel 32 may include a first position in which the second engagement member 50 is retracted relative to the inner mandrel 32, and a second position in which the second engagement member 50 is extended relative to the inner mandrel 32. The longitudinal positions of the retraction sleeve 54 may include a first position in which first engagement member 40 is extended relative to the inner mandrel 32, and a second position in which the retraction sleeve 54 retains the first engagement member 40 retracted relative to the inner mandrel 32.

The second engagement member 50 may extend in response to application of a first force to the inner mandrel 32 in a first longitudinal direction. The first engagement member 40 may retract in response to application of a second force to the inner mandrel 32 in a second longitudinal direction opposite to the first longitudinal direction.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," "upward," "downward," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A shifting tool for use in displacing a component of a well tool, the shifting tool comprising:

an inner mandrel;

at least one shifting key;

at least one reset dog; and a retraction sleeve, in which the at least one reset dog enables relative longitudinal displacement between the inner mandrel and the retraction sleeve, and in which the shifting key retracts relative to the inner mandrel in response to relative displacement between the retraction sleeve and the shifting key, and the reset dog extends relative to the inner mandrel in response to relative displacement between the inner mandrel and the reset dog.

2. The shifting tool of claim 1, in which the reset dog extends relative to the inner mandrel in response to displacement of the inner mandrel in a first longitudinal direction relative to the shifting key, and in which the shifting key retracts relative to the inner mandrel in response to displacement of the inner mandrel in a second longitudinal direction relative to the reset dog, the second longitudinal direction being opposite to the first longitudinal direction.

3. The shifting tool of claim 1, further comprising:

a first detent device that releasably secures the inner mandrel in at least two longitudinal positions relative to the shifting key; and a second detent device that releasably secures the retraction sleeve in at least two longitudinal positions relative to the shifting key.

4. The shifting tool of claim 3, in which the first detent device comprises at least one flexible collet.

5. The shifting tool of claim 3, in which the longitudinal positions of the inner mandrel include a first position in which the reset dog is retracted relative to the inner mandrel, and a second position in which the reset dog is extended relative to the inner mandrel.

6. The shifting tool of claim 3, in which the second detent device comprises at least one flexible collet.

7. The shifting tool of claim 3, in which the longitudinal positions of the retraction sleeve include a first position in which the shifting key is extended relative to the inner mandrel, and a second position in which the retraction sleeve retains the shifting key retracted relative to the inner mandrel.

8. A method of operating a shifting tool in a subterranean well, the method comprising:

engaging the shifting tool with a component of a well tool in the well; and applying a first force in a first direction from the shifting tool to the well tool component, thereby causing one or more reset dogs to extend into engagement with the well tool component, in which the reset dogs are urged radially outward by an inclined surface which displaces longitudinally relative to the reset dogs.

9. The method of claim 8, further comprising, after the step of applying the first force, applying a second force in a second direction from the shifting tool to the well tool component, the second direction being opposite to the first direction.

10. The method of claim 9, in which the engaging further comprises engaging shifting keys of the shifting tool with a profile of the well tool component, and in which the step of applying the second force further comprises disengaging the shifting keys from the profile.

11. The method of claim 9, in which the step of applying the second force further comprises applying the second force from the reset dogs to the component.

12. The method of claim 9, further comprising, after the step of applying the second force, displacing the shifting tool in the first direction relative to the well tool while the reset dogs remain engaged with the well tool component.

13. The method of claim 12, in which the engaging further comprises engaging shifting keys of the shifting tool with a profile of the well tool component, and in which the displacing further comprises extending the shifting keys outward from the shifting tool.

14. The method of claim 12, in which the displacing step comprises retracting the reset dogs out of engagement with the well tool component.

15. A shifting tool for use in displacing a component of a well tool, the shifting tool comprising:

an inner mandrel;

at least one first engagement member outwardly extendable relative to the inner mandrel;

a retraction sleeve;

at least one second engagement member outwardly extendable relative to the inner mandrel;

a first detent device that releasably secures the inner mandrel in at least two longitudinal positions relative to the first engagement member; and a second detent device that releasably secures the retraction sleeve in at least two longitudinal positions relative to the first engagement member.

16. The shifting tool of claim 15, in which the first detent device comprises at least one flexible collet.

17. The shifting tool of claim 15, in which the longitudinal positions of the inner mandrel include a first position in which the second engagement member is retracted relative to the inner mandrel, and a second position in which the second engagement member is extended relative to the inner mandrel.

18. The shifting tool of claim 15, in which the second detent device comprises at least one flexible collet.

19. The shifting tool of claim 15, in which the longitudinal positions of the retraction sleeve include a first position in which first engagement member is extended relative to the inner mandrel, and a second position in which the retraction sleeve retains the first engagement member retracted relative to the inner mandrel.

20. The shifting tool of claim 15, in which the second engagement member extends in response to application of a first force to the inner mandrel in a first longitudinal direction, and in which the first engagement member retracts in response to application of a second force to the inner mandrel in a second longitudinal direction opposite to the first longitudinal direction.

* * * * *